US011073297B2

(12) United States Patent
Li

(10) Patent No.: US 11,073,297 B2
(45) Date of Patent: Jul. 27, 2021

(54) AIR CONDITIONER DEFROSTING CONTROL METHOD AND DEVICE THEREOF

(71) Applicants: GD MIDEA HEATING & VENTILATING EQUIPMENT CO., LTD., Foshan (CN); MIDEA GROUP CO., LTD., Foshan (CN)

(72) Inventor: Jun Li, Foshan (CN)

( * ) Notice: Subject to any disclaimer, the term of this patent is extended or adjusted under 35 U.S.C. 154(b) by 1 day.

(21) Appl. No.: 16/628,029

(22) PCT Filed: Dec. 27, 2018

(86) PCT No.: PCT/CN2018/124385

§ 371 (c)(1),
(2) Date: Jan. 1, 2020

(87) PCT Pub. No.: WO2019/214254

PCT Pub. Date: Nov. 14, 2019

(65) Prior Publication Data

US 2020/0132323 A1 Apr. 30, 2020

(30) Foreign Application Priority Data

May 7, 2018 (CN) ..... 201810425172.1

(51) Int. Cl.
*F24F 11/00* (2018.01)
*F24F 11/42* (2018.01)
*F24F 11/61* (2018.01)

(52) U.S. Cl.
CPC ..... *F24F 11/42* (2018.01); *F24F 11/61* (2018.01)

(58) Field of Classification Search
CPC ..... F24F 11/41; F24F 11/42; F24F 11/61
See application file for complete search history.

(56) References Cited

U.S. PATENT DOCUMENTS 6,205,800 B1 * 3/2001 Topper ..... A47F 3/0404 62/156
2012/0186274 A1 * 7/2012 Cwiertniewicz ..... F25B 49/005 62/56
2020/0132323 A1 4/2020 Li

FOREIGN PATENT DOCUMENTS

CN 1156809 A 8/1997
CN 101737902 A 6/2010
(Continued)

OTHER PUBLICATIONS

The first Office Action dated Jul. 1, 2019 in the corresponding CN application No. 201810425172.1.
(Continued)

*Primary Examiner* — Jonathan Bradford
(74) *Attorney, Agent, or Firm* — Kilpatrick Townsend & Stockton, LLP

(57) ABSTRACT

Provided are an air conditioner defrosting control method and a device thereof. The air conditioner defrosting control method is: entering a defrosting mode, and detecting the number of defrosting operations executed in the present defrosting mode; according to the number of defrosting operations and an initially set defrosting time, setting the present set defrosting time recording the present defrosting time; detecting that the present defrosting time, and determining that the present defrosting time reaches the preset defrosting time; updating the number of defrosting operations; and setting the next set defrosting time. Through the air conditioner defrosting control method and device, the maximum defrosting time can be self-adaptively adjusted without affecting the use of a user, and preventing the accumulation of a frosting layer, and avoiding the risk of pipes bursting.

8 Claims, 4 Drawing Sheets

(56) References Cited

FOREIGN PATENT DOCUMENTS

| | | | |
|---|---|---|---|
| CN | 102032649 | A | 4/2011 |
| CN | 102853502 | A | 1/2013 |
| CN | 103486781 | A | 1/2014 |
| CN | 104006591 | A | 8/2014 |
| CN | 104236004 | A | 12/2014 |
| CN | 106288230 | A | 1/2017 |
| CN | 107202399 | A | 9/2017 |
| CN | 107917504 | A | 4/2018 |
| CN | 108679782 | A | 10/2018 |
| JP | H07139785 | A | 5/1995 |
| JP | 2002130876 | A | 5/2002 |
| JP | 2013113562 | A | 6/2013 |
| KR | 20070077637 | A | 7/2007 |
| WO | 2019214254 | A1 | 11/2019 |

OTHER PUBLICATIONS

The second Office Action dated Dec. 24, 2019 in the corresponding CN application No. 201810425172.1.
The third Office Action dated Mar. 24, 2020 in the corresponding CN application No. 201810425172.1.
International Search Report dated Mar. 22, 2019 in the corresponding International Application No. PCT/CN2018/124385.
OA for CA application 3,066,052.

* cited by examiner

AIR CONDITIONER DEFROSTING CONTROL METHOD AND DEVICE THEREOF

CROSS-REFERENCES TO RELATED APPLICATIONS

The present disclosure is a national phase application of International Application No. PCT/CN2018/124385, filed on Dec. 27, 2018, which claims the priority of Chinese Application No. 201810425172.1, filed with the Chinese Patent Office on May 7, 2018, the entireties of which are herein incorporated by reference.

FIELD

The present disclosure relates to the field of air conditioner, in particular, to a defrosting control method for air conditioner and a device thereof.

BACKGROUND

Multi-split central air conditioner has been widely used in small and medium-sized buildings and some public buildings. With the diversity of working conditions, the individualized needs from the users are becoming more and more complex, and the requirements for the reliability of multi-split central air conditioner are also increasing. During the heating operation in winter, the surface temperature of the outdoor heat exchanger will reach below zero to cause frost, and the frost layer may cause air flow to be blocked, affecting the heating capacity of the air conditioner, so that the user experience is getting worse. In addition, frosting may also lead dangerous hazards such as bursting of the copper tube. At present, the air conditioning system has increased the limit of the maximum defrosting time for the outdoor unit. During the operation of defrosting mode, even if the frosting layer is not cleaned, the defrosting mode will be immediately exited when the maximum defrosting time is reached. However, in extreme climates, for this method, there is still a situation in which the frost layer is thicker from the bottom to the top, resulting in poor heat exchange of the outdoor heat exchanger and incapability of the indoor unit in heating.

SUMMARY

The present disclosure aims to solve at least one of the above shortcomings in the prior art.

To this end, the first purpose of the present disclosure is to provide a defrosting control method for an air conditioner, which may adaptively adjust the maximum defrosting time, prevent the accumulation of frost layers, and avoids the risk of cracking of refrigerant pipe without affecting the usage of a user.

The second purpose of the present disclosure is to provide a defrosting control device for an air conditioner.

Embodiments of the present disclosure provide a defrosting control method for an air conditioner including:

entering a defrosting mode, and detecting the number of defrosting operations that have been performed in the defrosting mode;

setting a preset defrosting time according to the number of defrosting operations and an initially-set defrosting time;

recording a current defrosting time;

detecting the current defrosting time, and determining whether the current defrosting time reaches the preset defrosting time;

updating the number of defrosting operations; and setting a next-set defrosting time.

In one embodiment, the setting a next-set defrosting time includes:

setting the next-set defrosting time based on the updated number of defrosting operations and the initially-set defrosting time.

In one embodiment, the method further includes:

confirming and exiting the defrosting mode;

detecting the current defrosting time, and determining whether the current defrosting time does not reach the preset defrosting time; and setting the next-set defrosting time as the initially-set defrosting time.

In one embodiment, subsequent to the detecting the current defrosting time, and determining whether the current defrosting time does not reach the preset defrosting time, the method further includes:

resetting the number of defrosting operations to an initial setting.

In one embodiment, the setting a preset defrosting time according to the number of defrosting operations and an initially-set defrosting time includes:

obtaining a pre-set unit extension defrosting duration;

obtaining an extension defrosting time according to the unit extension defrosting duration and the number of defrosting operations; and setting the preset defrosting time according to the extension defrosting time and the initially-set defrosting time.

In one embodiment, the method further includes:

setting the initially-set defrosting time.

Through the following steps: entering a defrosting mode, and detecting the number of defrosting operations that have been performed in the defrosting mode; setting a preset defrosting time according to the number of defrosting operations and an initially-set defrosting time; recording a current defrosting time; detecting the current defrosting time, and determining whether the current defrosting time reaches the preset defrosting time; updating the number of defrosting operations; setting a next-set defrosting time, the defrosting control method for an air conditioner in the embodiment of the present disclosure may adaptively adjust the maximum defrosting time, prevent the accumulation of frost layers and avoid the risk of cracking of refrigerant pipe without affecting the usage of a user.

Embodiments of the present disclosure provide a defrosting control device for an air conditioner including a defrosting device, a first setting device, a recording device, an updating device and a second setting device; and the defrosting device is configured to detect the number of defrosting operations that have been performed in the defrosting mode;

the first setting device is configured to set a preset defrosting time according to the number of defrosting operations and an initially-set defrosting time;

the recording device is configured to record a current defrosting time;

the updating device is configured to detect and determine that a current defrosting time reaches the preset defrosting time to update the number of defrosting operations; and the second setting device is configured to set a next-set defrosting time.

In one embodiment, the second setting device is configured to set the next-set defrosting time based on the updated number of defrosting operations and the initially-set defrosting time.

In one embodiment, the device further includes an exiting device a determining device and a third setting device; and, the exiting device is configured to confirm and exit the defrosting mode;

the determining device is configured to detect and determine that the current defrosting time does not reach the preset defrosting time; and the third setting device is configured to set the next-set defrosting time as the initially-set defrosting time.

In one embodiment, the third setting device is configured to reset the number of defrosting operations to an initial setting.

In one embodiment, the first setting device is configured to obtain a pre-set unit extension defrosting duration, obtain an extension defrosting time according to the unit extension defrosting duration and the number of defrosting operations, and set the preset defrosting time according to the extension defrosting time and the initially-set defrosting time.

In one embodiment, the device further includes a setting device;

the setting device is configured to set the initially-set defrosting time.

Through the following steps, the defrosting control device for an air conditioner in the embodiment of the present disclosure may adaptively adjust the maximum defrosting time, prevent the accumulation of frost layers and avoid the risk of cracking of refrigerant pipe without affecting the usage of a user: entering a defrosting mode, and detecting the number of defrosting operations that have been performed in the defrosting mode; setting a preset defrosting time according to the number of defrosting operations and an initially-set defrosting time; recording a current defrosting time; detecting the current defrosting time, and determining whether the current defrosting time reaches the preset defrosting time; updating the number of defrosting operations; setting a next-set defrosting time.

Embodiments of the present disclosure provide an air conditioner including: a processor; a memory; and a computer program stored in the memory and executable by the processor, and the computer program, when executed by the processor, causes a defrosting control method for air conditioner according to the embodiments to be performed.

Embodiments of the present disclosure provide a computer readable storage medium having stored therein a computer program that, when executed by a processor, causes a defrosting control method for air conditioner according to the embodiments to be performed.

BRIEF DESCRIPTION OF THE DRAWINGS

Embodiments of the present disclosure will become apparent and readily understood with combination of the following drawings, in which.

DETAILED DESCRIPTION OF THE DISCLOSURE

Figure 1:
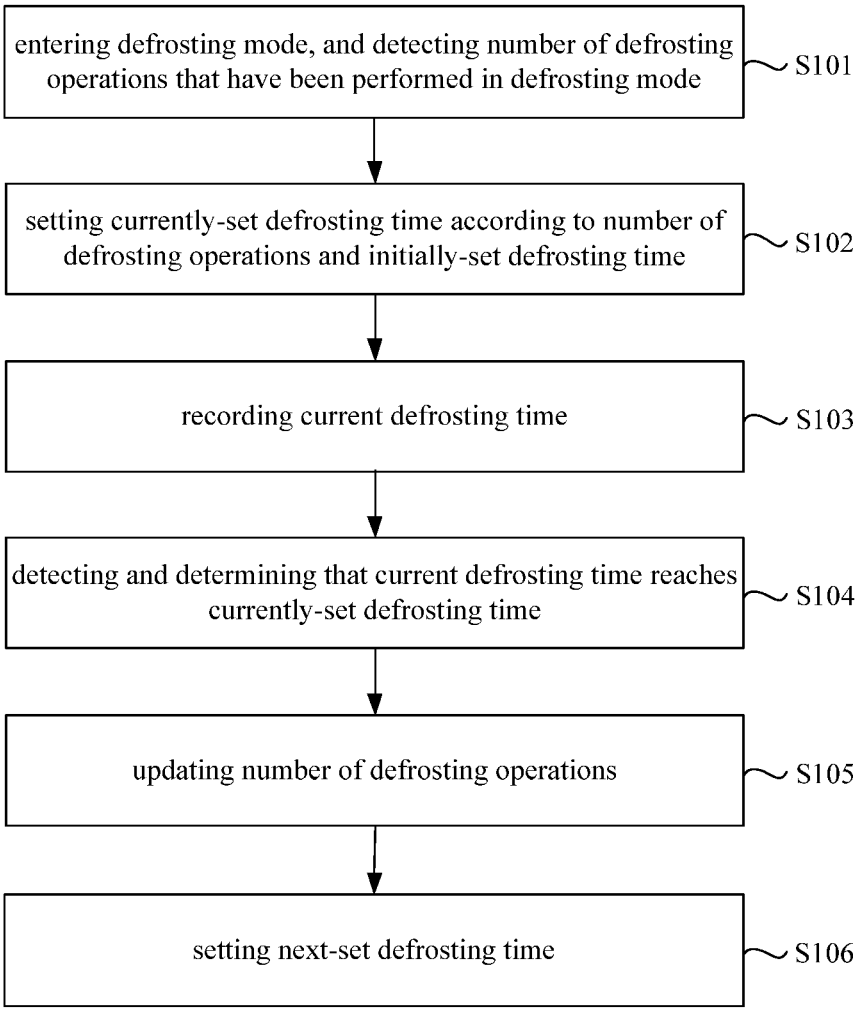
FIG. 1 is a flow chart of a defrosting control method for air conditioner provided by an embodiment of the present disclosure.

Below is detailed description of embodiments of the present disclosure, which are shown in the drawings. Throughout the drawings, same or similar reference signs identify same or similar elements or elements having same or similar functions. The embodiments described below in conjunction with the drawings are illustrative, i.e., the embodiments are intended to illustrate the present disclosure, but not to limit the present disclosure.

The defrosting control method for an air conditioner and a device thereof according to the embodiment of the present disclosure will be described below with reference to the accompanying drawings.

FIG. 1 is a flow chart of a defrosting control method for air conditioner provided by an embodiment of the present disclosure.

As shown in FIG. 1, the defrosting control method for air conditioner includes steps of:

S101, entering a defrosting mode, and detecting the number of defrosting operations that have been performed in the defrosting mode.

In extreme climates, such as in cold winters, the surface temperature of the outdoor unit of the air conditioner may reach below zero to cause frost, and the frost layer may cause air flow to be blocked, and affecting the heating capacity of the air conditioner. To this end, most air conditioning systems have added a defrosting mode, for example, when the temperature of the outside air is lower than a predetermined temperature, the system enters the defrosting mode. The defrosting mode usually has a maximum defrosting time, which functions to prevent the normal use of the user from being affected due to the low temperature of the indoor air. During the operation of defrosting mode, even if the frosting layer is not cleaned, the defrosting mode will be immediately exited when the maximum defrosting time is reached. This will make the frost layer become thicker over time. Therefore, the present disclosure provides a method capable of adaptively adjusting the maximum defrosting time to solve the above problem.

In the present embodiment, after the air conditioner enters a defrosting mode, the number of defrosting operations that have been performed in the defrosting mode is detected, and an initial value of the number of defrosting operations may be set in advance, for example, the initial value of the number of defrosting operations is set to zero. The air conditioner continues to perform defrosting in the defrosting mode; whenever the defrosting time reaches a set defrosting time of the local defrosting, the number of defrosting operations is increased by 1, and the number of defrosting operations that have been performed is detected before the next defrosting.

S102, setting a preset defrosting time according to the number of defrosting operations and an initially-set defrosting time.

Among them, the initially-set defrosting time is preset, for example, the initially-set defrosting time may be set to 5 minutes.

In an implementation of the embodiment of the present disclosure, a correspondence between the number of different defrosting operations and an increased defrosting duration may be preset and stored in the air conditioner, so that after the number of defrosting operations that have been performed in the current defrosting mode is detected, the increased defrosting duration corresponding to the detected number of defrosting operations may be determined by querying the pre-stored correspondence, and further a sum of the initially-set defrosting time and the increased defrosting duration may be calculated for setting the value of resulting sum to a preset defrosting time.

In an possible implementation of the embodiment of the present disclosure, a unit extension defrosting duration may be preset and stored; when the preset defrosting time is set, first the preset unit extension defrosting duration may be obtained, and then an extension defrosting time according to the unit extension defrosting duration and the detected number of defrosting operations is obtained, and further the preset defrosting time may be set according to the extension defrosting time and the initially-set defrosting time. For example, it is assumed that the preset initially-set defrosting time is T, an initial value of the number of defrosting operations is 0, and the unit extension defrosting time is T0. When the air conditioner enters the defrosting mode, first the number (0) of defrosting operations that have been performed in the current defrosting mode is detected, and then the set defrosting time for initial defrosting is the initially-set defrosting time. When the defrosting time for initial defrosting reaches the initially-set defrosting time, the number of defrosting operations is increased by 1 if the condition for exiting the defrosting mode is not met, and then an extension defrosting time is obtained according to the currently-detected number (1) of defrosting operations that have been performed and the unit extension defrosting duration T0, i.e., the extension defrosting time is 1*T0; and then, a secondly-set defrosting time is set as T+1*T0 according to the extension defrosting time and the initially-set defrosting time, to perform defrosting with T+1*T0 as a maximum defrosting time for the second defrosting; if the condition for exiting the defrosting mode is still not met when the current defrosting time reaches the set defrosting time T+1*T0, the number of defrosting operations is further increased by 1, and then, an extension defrosting time is obtained according to the currently-detected number (2) of defrosting operations that have been performed and the unit extension defrosting duration T0, i.e., the extension defrosting time is 2*T0, and a preset (thirdly-set) defrosting time is obtained as T+2*T0, to perform defrosting with T+2*T0 as a maximum defrosting time for the third defrosting. The above process is repeated until the defrosting mode is exited when the conditions for exiting the defrosting mode are met. That is, if the maximum defrosting time is performed for each defrosting in the current defrosting mode, performing for the initially-set defrosting time may not completely eliminate the frost layer of the air conditioner, so the maximum defrosting time is extended slightly without affecting the user's use to increase the defrosting time and prevent the frost layer from accumulating.

S103, recording a current defrosting time.

After the set defrosting time for the current defrosting is set, the process of current defrosting may be entered and the current defrosting time is recorded. For example, the defrosting time for the current defrosting may be recorded by a timer. Among them, the timer may be controlled by a controller in the air conditioner, and the controller controls the timer to reset to an initial value each time the preset defrosting time is set, such as controlling the timer to clear.

S104, detecting the current defrosting time, and determining whether the current defrosting time reaches the preset defrosting time.

For example, a time variation of the timer may be detected in real time; when a timing variation of the timer is detected as the preset defrosting time, the current defrosting time is determined to reach the preset defrosting time.

S105, updating the number of defrosting operations.

When the current defrosting time is determined to reach the preset defrosting time, the maximum defrosting time is reached before the current defrosting completely eliminates the frost layer, then the number of defrosting operations may be updated, i.e., the number of defrosting operations may be added by one.

S106, setting a next-set defrosting time.

In the present embodiment, the next-set defrosting time may be set based on the updated number of defrosting operations and the initially-set defrosting time.

In an implementation of the embodiment of the present disclosure, according to the correspondence between a preset number of defrosting operations and an increased defrosting duration, a corresponding increased defrosting duration may be obtained according to the updated number of defrosting operations, and further the next-set defrosting time is set according to the increased defrosting duration and the initially-set defrosting time.

In an implementation of the embodiment of the present disclosure, the next-set defrosting time may be set according to the preset initially-set defrosting time, the unit extension defrosting duration, and the updated number of defrosting operations.

For example, it is assumed that the initially-set defrosting time is 10 minutes, the unit extension defrosting duration is 2 minutes and the detected number of defrosting operations that have been performed in the current defrosting mode is 3, then the set defrosting time for the current defrosting is 16 minutes. If the defrosting time for the current defrosting reaches the set defrosting time of 16 minutes, the number of defrosting operations becomes to 4, and then, the set defrosting time for the next defrosting is calculated as 18 minutes based on the calculation method in step S102 to set the set defrosting time for the next defrosting as 18 minutes.

Through the following steps: entering a defrosting mode, and detecting the number of defrosting operations that have been performed in the defrosting mode; setting a preset defrosting time according to the number of defrosting operations and an initially-set defrosting time; recording a current defrosting time; detecting the current defrosting time, and determining whether the current defrosting time reaches the preset defrosting time; updating the number of defrosting operations; setting a next-set defrosting time, the defrosting control method for an air conditioner in the embodiment of the present disclosure may adaptively adjust the maximum defrosting time, prevent the accumulation of frost layers and avoid the risk of cracking of refrigerant pipe without affecting the usage of a user.

Figure 2:
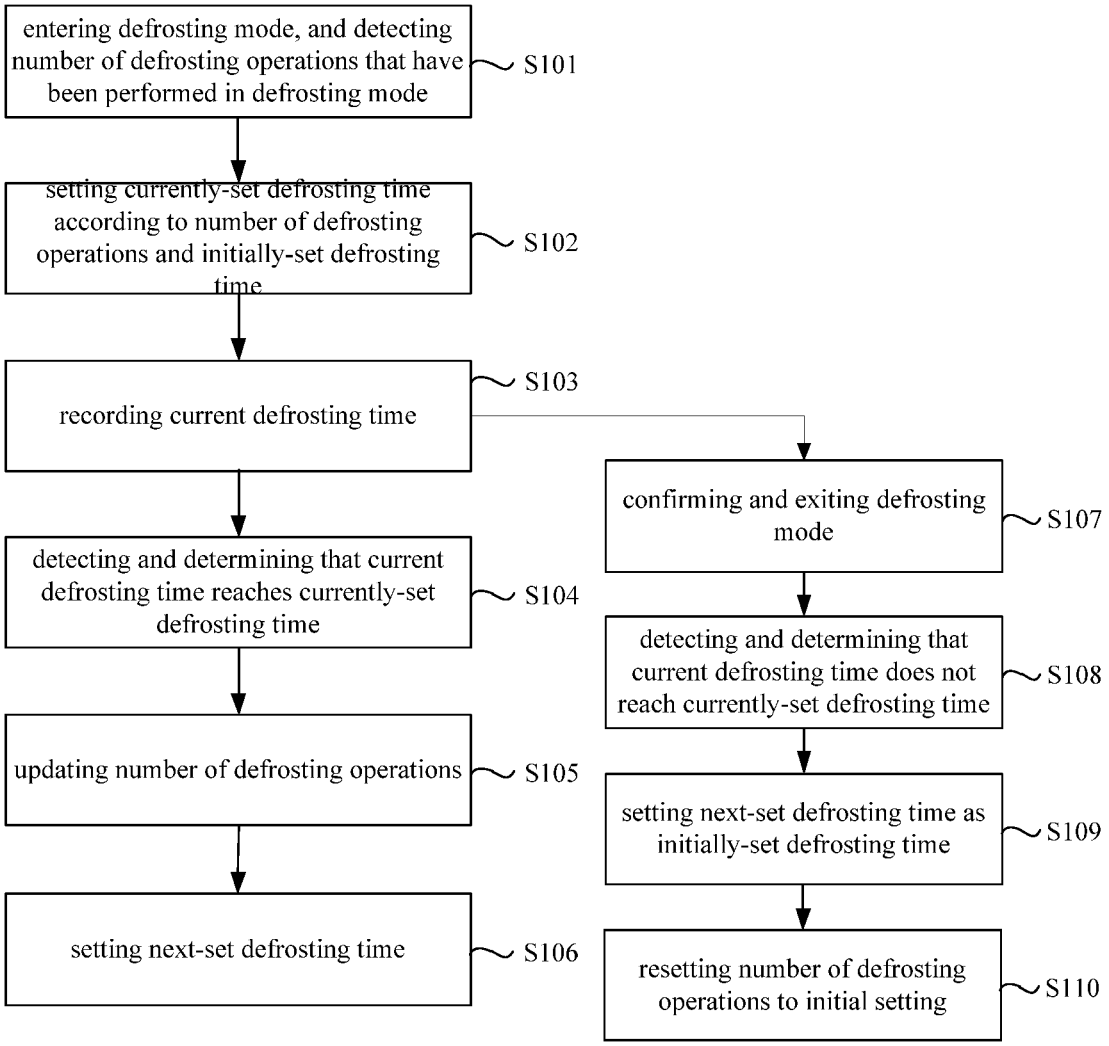
FIG. 2 is a flow chart of a defrosting control method for air conditioner provided by another embodiment of the present disclosure.

In another embodiment of the present disclosure, as shown in FIG. 2, the defrosting control method for air conditioner may further include steps of:

S107, confirming and exiting the defrosting mode.

As an example, the switching state of the defrosting mode of the air conditioner may be monitored in real time; when it is detected that the defrosting mode of the air conditioner is changed from the open state to the closed state, indicating that the frost layer of the air conditioner has been completely melted, it is confirmed that the defrosting mode is exited.

S108, detecting the current defrosting time, and determining whether the current defrosting time does not reach the preset defrosting time.

S109, setting the next-set defrosting time as the initially-set defrosting time.

S110, resetting the number of defrosting operations to an initial setting.

When the defrosting mode is exited, a count of the timer at this time is read, and the read data is compared with the preset defrosting time; if read data is less than the preset defrosting time, it is determined that the current defrosting time does not reach the preset defrosting time, then the next-set defrosting time is set to the initially-set defrosting time, and the number of defrosting operations is reset to the initial setting. For example, when the preset number of defrosting operations is 0, the number of defrosting operations is reset to 0.

It should be noted that setting the next-set defrosting time as the initially-set defrosting time in step 109 refers to that the set defrosting time for the first defrosting is the initially-set defrosting time when the defrosting mode is entered again. That is, the set defrosting time for the first defrosting is the initially-set defrosting time each time the defrosting mode is entered.

Further, it should be noted that steps 109 and 110 are performed in no particular order, for example, step 109 may be performed first and then step 110 may be performed, or step 110 may be performed first and then step 109 may be performed, or steps 109 and 110 may be performed simultaneously. FIG. 2 only illustrates an example of the execution of step 110 after step 109, which should not be considered as a limitation.

For the defrosting control method for air conditioner of the embodiment of the present disclosure, by confirming and exiting the defrosting mode, detecting the current defrosting time, and determining whether the current defrosting time does not reach the preset defrosting time, setting the next-set defrosting time as the initially-set defrosting time, and resetting the number of defrosting operations to an initial setting, the initially-set defrosting time is used as the maximum defrosting time for defrosting each time the defrosting mode is entered, to avoid the set defrosting time of the first defrosting to be longer, and realizing the automatic reset of the initially-set defrosting time and the number of defrosting operations.

Embodiments of the present disclosure further provide a defrosting control device for air conditioner.

Figure 3:
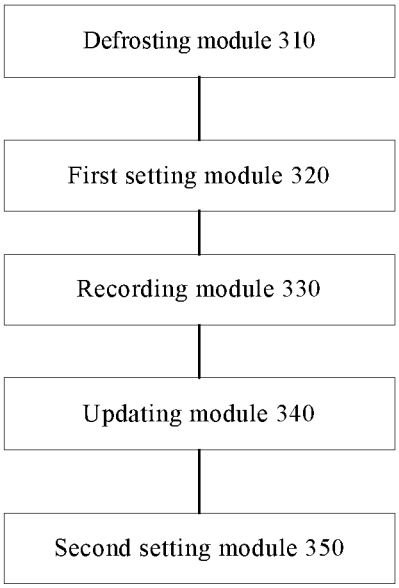
FIG. 3 is a structural diagram of a defrosting control device for air conditioner provided by an embodiment of the present disclosure.

As shown in FIG. 3, the defrosting control device for air conditioner may include a defrosting device 310, a first setting device 320, a recording device 330, an updating device 340, and a second setting device 350.

The defrosting device 310 is configured to detect the number of defrosting operations that have been performed in the defrosting mode.

The first setting device 320 is configured to set a preset defrosting time according to the number of defrosting operations and an initially-set defrosting time.

In an implementation of the embodiment of the present disclosure, the first setting device 320 is configured to obtain a pre-set unit extension defrosting duration, obtain an extension defrosting time according to the unit extension defrosting duration and the number of defrosting operations, and set the preset defrosting time according to the extension defrosting time and the initially-set defrosting time.

The recording device 330 is configured to record a current defrosting time.

The updating device 340 is configured to detect and determine that a current defrosting time reaches the preset defrosting time to update the number of defrosting operations.

The second setting device 350 is configured to set a next-set defrosting time.

In one embodiment, the second setting device 350 is configured to set the next-set defrosting time based on the updated number of defrosting operations and the initially-set defrosting time.

Figure 4:
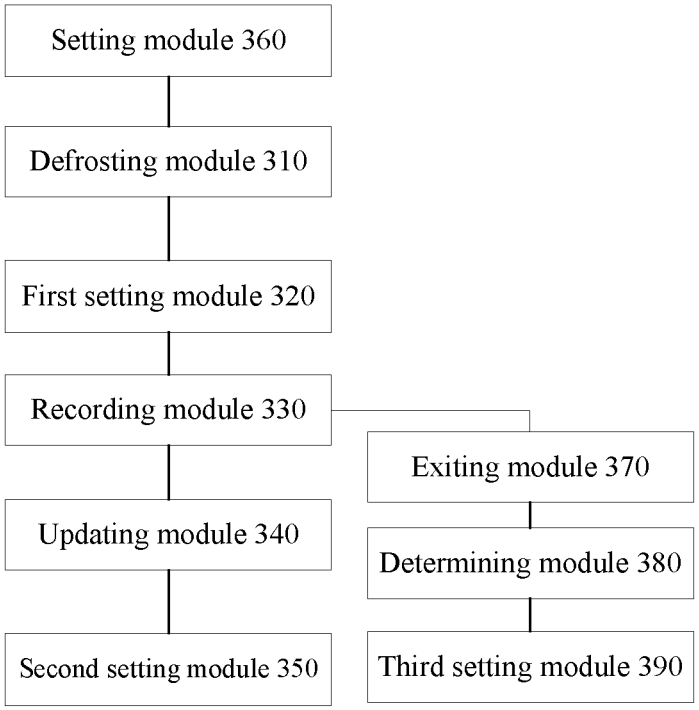
FIG. 4 is a structural diagram of a defrosting control device for air conditioner provided by another embodiment of the present disclosure.

In another embodiment of the present disclosure, as shown in FIG. 4, the defrosting control device for air conditioner may further include a setting device 360, an exiting device 370, a determining device 380, and a third setting device 390.

The setting device 360 is configured to set the initially-set defrosting time.

The exiting device 370 is configured to confirm and exit the defrosting mode.

The determining device 380 is configured to detect and determine that the current defrosting time does not reach the preset defrosting time.

The third setting device 390 is configured to set the next-set defrosting time as the initially-set defrosting time.

In another embodiment of the present disclosure, the third setting device 390 is further configured to reset the number of defrosting operations to an initial setting.

It should be noted that the foregoing explanation of the defrosting control method for air conditioner is also applicable to the defrosting control device for air conditioner of the embodiment of the present disclosure, and details that are not disclosed in the embodiment of the present disclosure are not described herein again.

Through the following steps: entering a defrosting mode, and detecting the number of defrosting operations that have been performed in the defrosting mode; setting a preset defrosting time according to the number of defrosting operations and an initially-set defrosting time; recording a current defrosting time; detecting the current defrosting time, and determining whether the current defrosting time reaches the preset defrosting time; updating the number of defrosting operations; setting a next-set defrosting time, the defrosting control device for an air conditioner in the embodiment of the present disclosure may adaptively adjust the maximum defrosting time, prevent the accumulation of frost layers and avoid the risk of cracking of refrigerant pipe without affecting the usage of a user.

Embodiments of the present disclosure further provide an air conditioner.

Figure 5:
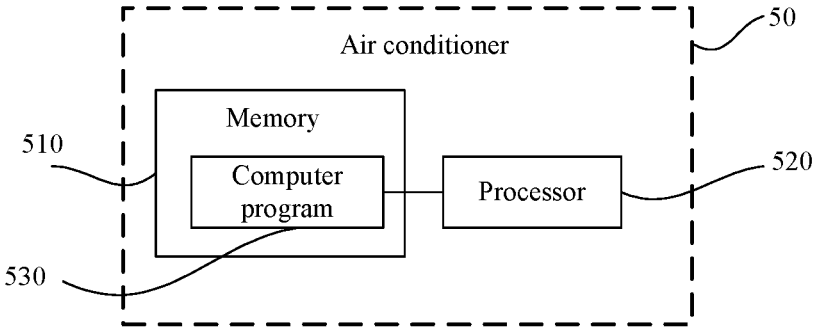
FIG. 5 is a structural diagram of an air conditioner provided by an embodiment of the present disclosure.

FIG. 5 is a structural diagram of an air conditioner provided by an embodiment of the present disclosure. As shown in FIG. 5, the air conditioner 50 includes a memory 510, a processor 520 and a computer program 530 stored in the memory 510 and executable by the processor 520; when the computer program 530 is executed by the processor 520, the defrosting control method for air conditioner according to the forgoing embodiments of the disclosure is performed.

Embodiments of the present disclosure further provide a computer readable storage medium having stored therein a computer program that, when executed by a processor, causes a defrosting control method for air conditioner according to the forgoing embodiments of the present disclosure to be performed.

In the description of the present specification, the description with reference to the terms "an embodiment", "some embodiments", "example", "specific example", or "some examples" and the like means that specific features, structures, materials, or features described in connection with the embodiments or examples are included in at least one embodiment or example of the present disclosure. In the present specification, the schematic representation of the above terms does not necessarily mean the same embodiment or example. Furthermore, the particular features, structures, materials, or features described may be combined in a suitable manner in any one or more embodiments or examples.

Besides, the terms "first" and "second" are used only for description and shall not be interpreted as an indication or implication of relative importance or an implicit indication of the number of features. Thus, features defined with "first", "second" may include at least one such feature, either explicitly or implicitly. In the description of the present disclosure, the meaning of "a plurality" is at least two, such as two, three, etc., unless specifically defined otherwise.

Any process or method description in the flowcharts or otherwise described herein may be understood to represent a device, segment or portion of code including one or more executable instructions for implementing the steps of a custom logic function or process, and the scope of the embodiments of the present disclosure includes additional implementations in which functions may not be performed in the order shown or discussed.

The logic and/or steps represented in the flowcharts or otherwise described herein, for example, may be considered as an ordered list of executable instructions for implementing logical functions, and may be embodied in any computer readable medium for use by or in connection with an instruction execution system, apparatus, or device (e.g., a computer-based system, a system including a processor, or other system that can fetch instructions from an instruction execution system, apparatus, or device and execute instructions). For the purposes of this specification, a "computer-readable medium" can be any apparatus that can contain, store, communicate, propagate, or transport a program for use in an instruction execution system, apparatus, or device, or in conjunction with the instruction execution system, apparatus, or device. More specific examples (non-exhaustive list) of computer readable media include electrical connection (electronic device) having one or more wirings, portable computer disk cartridge (magnetic device), random access memory (RAM), read only memory (ROM), erasable and editable read-only memory (EPROM or flash memory), fiber optic devices, and portable compact disk read-only memory (CDROM). Additionally, since a program can be obtained electronically, for example by optical scanning of paper or other medium, followed by editing, interpretation or, if necessary, processing in other suitable manner, and then storing it in computer memory, the computer readable medium can even be a paper or other suitable medium on which the program can be printed.

It should be understood that portions of the present disclosure may be implemented in hardware, software, firmware or a combination thereof. In the above-described embodiments, multiple steps or methods may be implemented in software or firmware stored in a memory and executed by a suitable instruction execution system. In one embodiment, if implemented in hardware and in another embodiment, it can be implemented by any of the following techniques or combinations thereof well known in the art: discrete logic circuit with logic gates for implementing logic functions on data signals, ASIC with appropriate combinational logic gate, Programmable Gate Array (PGA), Field Programmable Gate Array (FPGA), etc.

In addition, the functional units in the embodiments of the present disclosure can be integrated in one processing device or each unit may independently physically exist, or two or more units may be integrated into one device. The integrated devices can be implemented in the form of hardware, and can also be implemented in the form of a software functional device. If the integrated devices are implemented in the form of a software functional device and sold or used as an independent product, they can be stored in a computer-readable storage medium.

What is claimed is:

1. A defrosting control method for an air conditioner, comprising:

entering a defrosting mode and detecting a number of defrosting operations that have been performed in the defrosting mode;

setting a preset defrosting time according to the number of defrosting operations and an initially-set defrosting time;

recording a current defrosting time;

detecting the current defrosting time, and determining whether the current defrosting time reaches the preset defrosting time;

updating the number of defrosting operations; and setting a next-set defrosting time.

2. The method according to claim 1, wherein the setting a next-set defrosting time comprises:

setting the next-set defrosting time based on an updated number of defrosting operations and the initially-set defrosting time.

3. The method according to claim 1, further comprising:

confirming the air conditioner is in the defrosting mode, and instructing the air conditioner to exit the defrosting mode;

detecting the current defrosting time, and determining that the current defrosting time does not reach the preset defrosting time; and setting the next-set defrosting time as the initially-set defrosting time.

4. The method according to claim 3, after detecting the current defrosting time, and determining that the current defrosting time does not reach the preset defrosting time, further comprising:

resetting the number of defrosting operations to an initial setting.

5. The method according to claim 1, wherein the setting a preset defrosting time according to the number of defrosting operations and an initially-set defrosting time comprises:

obtaining a pre-set unit extension defrosting duration;

obtaining an extension defrosting time according to an unit extension defrosting duration and the number of defrosting operations; and setting the preset defrosting time according to the extension defrosting time and the initially-set defrosting time.

6. The method according to claim 1, further comprising:

setting the initially-set defrosting time.

7. An air conditioner, comprising:

a processor; a memory; and a computer program stored in the memory and executable by the processor, wherein the computer program, when executed by the processor, causes the air conditioner to perform a defrosting control method according to claim 1.

8. A non-transitory computer readable storage medium having stored therein a computer program that, when executed by a processor, causes an air conditioner to perform a defrosting control method according to claim 1.

* * * * *